US005417179A

United States Patent [19]

Niemier et al.

[11] Patent Number: 5,417,179

[45] Date of Patent: May 23, 1995

[54] BRACE MEMBER FOR SIT-ON-TOP KAYAKS

[75] Inventors: Timothy A. Niemier, 1731 Old Samish Rd., Bellingham, Wash. 98226; Michael G. Baker, Bellingham, Wash.

[73] Assignee: Timothy A. Niemier, Bellingham, Wash.

[21] Appl. No.: 108,104

[22] Filed: Aug. 16, 1993

[51] Int. Cl.[6] ..... B63B 35/71

[52] U.S. Cl. ..... 114/347; 114/363

[58] Field of Search ..... 114/347, 363; 441/65

[56] References Cited

U.S. PATENT DOCUMENTS

| | | | |
|---|---|---|---|
| 3,627,073 | 12/1971 | Grimm . | |
| 3,769,645 | 11/1973 | Lettman | 114/363 |
| 4,106,143 | 8/1978 | Lucas | 114/363 |
| 4,589,365 | 5/1986 | Masters | 114/347 |
| 4,660,490 | 4/1987 | Broadhurst | 114/363 |
| 4,710,143 | 12/1987 | Boulanger | 114/363 |
| 4,744,327 | 5/1988 | Masters | 114/347 |
| 4,843,999 | 7/1989 | Kobus et al. | 114/347 |
| 4,942,840 | 7/1990 | Masters et al. | 114/347 |
| 5,189,974 | 3/1993 | Masters | 114/347 |

FOREIGN PATENT DOCUMENTS

| | | | |
|---|---|---|---|
| 2673416 | 4/1992 | France | 114/347 |

*Primary Examiner*—Jesus D. Sotelo

*Attorney, Agent, or Firm*—Hughes, Multer and Schacht

[57] ABSTRACT

A sit-on-top kayak having a brace member mounted in the cockpit area between the kayaker's legs. The brace member is outwardly canted and forwardly flared to accommodate the kayaker's legs. The brace member does not extend over the top of the kayaker's legs, but is instead gripped therebetween to allow the kayaker to have more control of the kayak. The brace member should be adjustable fore and aft to accommodate different kayakers.

14 Claims, 5 Drawing Sheets

BRACE MEMBER FOR SIT-ON-TOP KAYAKS

TECHNICAL FIELD

The present invention relates to sit-on-top kayaks and, more particularly, to braces that can be grasped between a user's knees or lower thighs to maintain the user's position in and control the kayak.

BACKGROUND OF THE INVENTION

A traditional kayak is a canoe-like watercraft having a hull with a narrow beam and a small opening in the center top portion thereof. The kayaker inserts his or her legs into this opening and sits inside the hull with the legs extending forward into the hull substantially parallel to the water. The opening is sized and dimensioned to be not much larger than the kayaker's waste. The kayaker is said to be "wearing" the kayak, and the close contact between kayaker and kayak is desired for precise control of the craft.

The beam of a traditional kayak is very short in comparison to its length. While fast and efficient, the design of a traditional kayak is fairly unstable; the narrow beam and shallow draft tend to cause the craft to roll easily.

In the last twenty years, a new type of kayak has been developed and has gained increasing acceptance. This new type of kayak will be referred to herein as a sit-on-top kayak. As this name suggests, the user of a sit-on-top kayak sits in an open cockpit on top of the kayak hull. The sit-on-top kayak is somewhat similar to a surfboard in overall shape, but normally has a generally v-shaped hull portion and a deeper draft to allow better tracking. Modern sit-on-top kayaks are conventionally formed out of polyethylene using a rotational molding process.

The design of a sit-on-top kayak has an advantage over traditional kayak designs in that the user need not learn to roll the craft or self-rescue when the craft has rolled because the user's legs do not extend into the kayak hull. The kayaker merely falls out of the kayak cockpit area when the kayak flips over.

Further, the beam of a sit-on-top kayak is relatively wide in comparison to a traditional kayak. While they somewhat decrease the speed and efficiency of the craft, these dimensions greatly increase the stability thereof. A sit-on-top kayak is thus easier to use than the traditional kayak. In addition, a sit-on-top kayak normally comprises a hollow, airtight hull that will not sink when flipped over.

However, it has long been recognized that the sit-on-top kayak may be more difficult to control in surf or broken water than a traditional kayak. This is because sit-on-top kayakers do not have their legs within the hull to keep them closely in contact with the kayak. The operator of a sit-on-top kayak is thus not as closely integrated with the kayak as the operator of a traditional kayak.

FIG. 6 depicts one method sit-on-top kayakers have employed to obtain more control over their craft. In particular, a typical sit-on-top kayak is generally depicted at 20 in FIG. 6. The kayaker is indicated at 22. The kayaker 22 is propelling the kayak 20 with a paddle 24.

Shown at 26 and 28 respectively are knee straps that maintain the kayaker 22 on top of the kayak 20. Referring more particularly to the knee strap 26, FIG. 6 shows that this strap 24 is connected to the kayak 22 at points 30 and 32 fore and aft, respectively, of a knee 34 of the kayaker 22. The strap 26 extends around the knee 34 to allow the kayaker 22 to control the kayak 20.

The knee straps 26 and 28 shown in FIG. 6, while nominally effective at allowing the kayaker 22 to control the kayak 20 under surf or broken water conditions, are undesirable for the following reasons. First, these straps 26 and 28 can be uncomfortable during use. Further, the kayaker's legs are immobilized when the straps 26 and 28 are in use, which tends to increase fatigue in the kayaker. Also, getting into the straps 26 and 28 requires the use of the hands. As the kayaker's hands are often busy manipulating the paddle 24, getting the kayaker's knees into the straps 26 and 28 can be inconvenient.

Straps that are somewhat similar to the straps 26 and 28 described above are shown in U.S. Pat. No. 5,189,974 to Masters. In the Masters '974 patent, kneeling operators of a kayak catamaran are depicted with straps over the kayakers' thighs just behind the knees. Such straps would be inappropriate for use in a sitting position.

Another method of maintaining the kayaker on top of a sit-on-top kayak or similar craft is disclosed in U.S. Pat. No. 4,106,143 to Lucas, U.S. Pat. No. 4,589,365 to Masters, and French Pat. No. 2,673,416. In all of these patents, brace members generally extend over the top of a substantial portion of the operator's thighs to allow the kayaker to control the craft. In Lucas the brace members outwardly extend from a rigid support that extends upwardly from the hull between the operator's thighs. The brace members in Masters '365 and the French patent are mounted on the sidewalls of an open cockpit kayak and extend inwardly over the top of the kayaker's thighs.

While brace members such as are described in Lucas, Masters '365, and the French patent allow the kayaker to control the kayak in a manner similar to that of a conventional kayak, these devices have the disadvantage of the traditional kayak in that the kayaker is essentially locked onto the craft should the craft flip. This approach thus eliminates one of the major advantages of a sit-on-top kayak over the traditional kayak.

The Applicant is also aware of the following U.S. Pat. Nos. (a) 3,769,645 to Lettman; (b) 4,843,999 to Kobus et al.; (c) 4,942,840 to Masters et al.; (d) 4,744,327 to Masters; and (e) 3,627,073 to Grimm. The Lettman and Kobus et al. patents disclose seating arrangements for water craft that require the user to kneel rather than sit while operating the craft. The Masters et al. patent and the Masters '327 patent relate to foot braces and do not address the problem described above. The Grimm patent discloses a snowmobile seat having a brace similar to that disclosed in the Lucas patent described above. These patents do not relate to the present invention and are disclosed herein as background information.

OBJECTS OF THE INVENTION

From the foregoing it should be apparent that a primary object of the present invention is to provide improved sit-on-top kayaks that allow the operators thereof to control these kayaks in rough water and surf while maintaining the ease of learning and use for which sit-on-top kayaks are noted.

Another important, but more specific, object of the present invention is to provide brace members for sit-on-top kayaks that provides a favorable mix of the following factors:

a. can be easily incorporated in the design of a rotationally molded polyethylene kayak hull;
b. allow ease of ingress and egress without use of the hands;
c. are reliable in operation; and
d. may be inexpensively fabricated.

Additional objects and advantages of the present invention will become apparent from the following description and accompanying drawings.

SUMMARY OF THE INVENTION

There has been invented, and disclosed herein, a new and novel sit-on-top kayak employing a brace member that extends upwardly between the kayaker's legs in the kayak cockpit area. The brace member does not extend over the kayaker's legs, but is instead gripped between the legs and thus does not lock the kayaker's legs into the cockpit area. The brace member has side surfaces contoured to facilitate this gripping action. To exit the cockpit area, the kayaker need only relax the pressure on the brace member and displace the legs up out of the cockpit area in a normal standing motion. If the kayak has flipped, the kayaker need only relax the legs and fall out of the cockpit area.

The kayaker's legs come into contact with port and starboard side surfaces of the brace member. These side surfaces are outwardly canted and flared in the forward direction. These side surfaces thus conform to the kayaker's legs and present a large contact area to comfortably distribute loads between the brace member and the kayaker's legs.

The relationship between the brace member and the wall surrounding the cockpit should be such that the brace member is slightly above the cockpit wall. This helps to prevent the kayaker's legs from being trapped within the cockpit by the brace member.

The brace member is preferably adjustable forward and aft to allow the kayaker to arrange it in a comfortable position. The brace member is preferably mounted in the cockpit area by straps that are attached to the kayak hull and which extend over at least a portion of the brace member. To prevent lateral movement of the brace member relative to the hull and thereby facilitate transfer of loads between the kayaker and the kayak, a slot may be formed in the hull and a corresponding projection may be formed on a bottom surface of the brace member. The brace projection is received within the slot in a manner that allows forward and aft movement of the brace member but which prevents lateral movement thereof relative tot he hull.

DETAILED DESCRIPTION OF THE INVENTION

Figure 1:
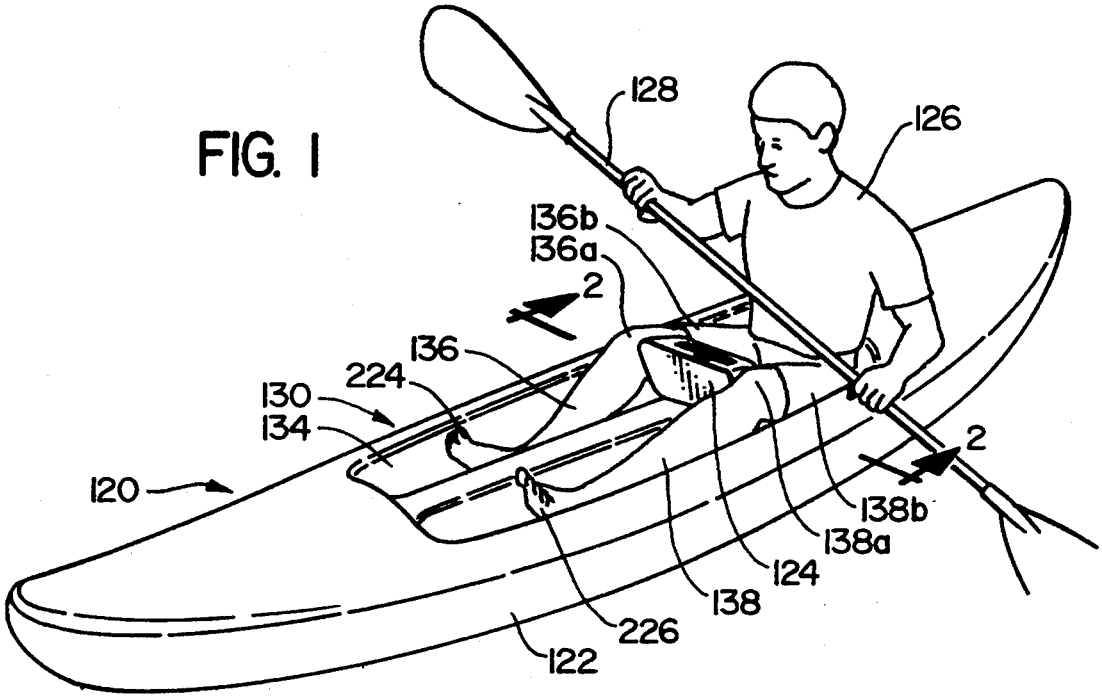
FIG. 1 is a perspective view of an exemplary sit-on-top kayak incorporating a brace member constructed in accordance with the present invention.

Referring now to FIG. 1 of the drawing, generally depicted at 120 therein is a kayak 120 comprising a hull 122 on which is mounted a brace member 124 constructed in accordance with, and embodying, the principles of the present invention.

Figure 2:
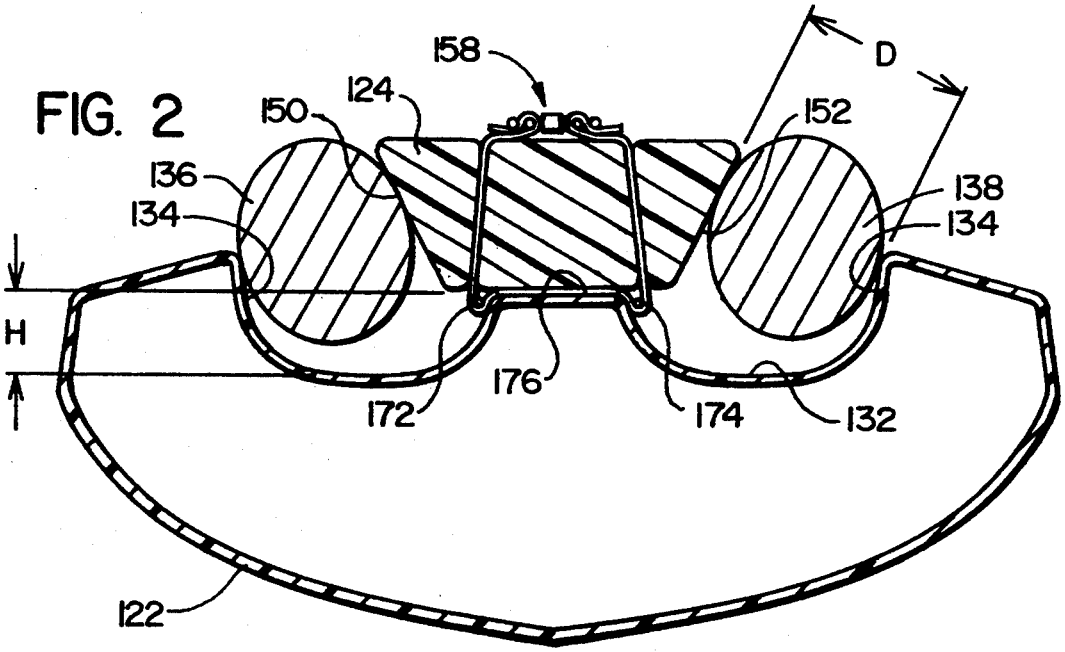
FIG. 2 is a cut-away view taken along lines 2—2 in FIG. 1 showing a first means for fixing the brace member relative to the kayak hull and the relationship between the brace member and the walls surrounding the cockpit.
Figure 6:
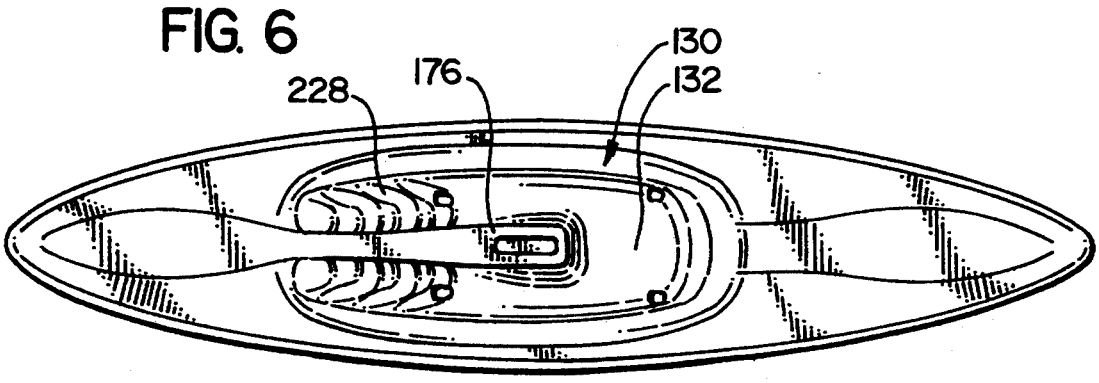
FIG. 6 is a top, plan view of the kayak depicted in FIG. 1 with the brace member and kayaker removed.
Figure 8:
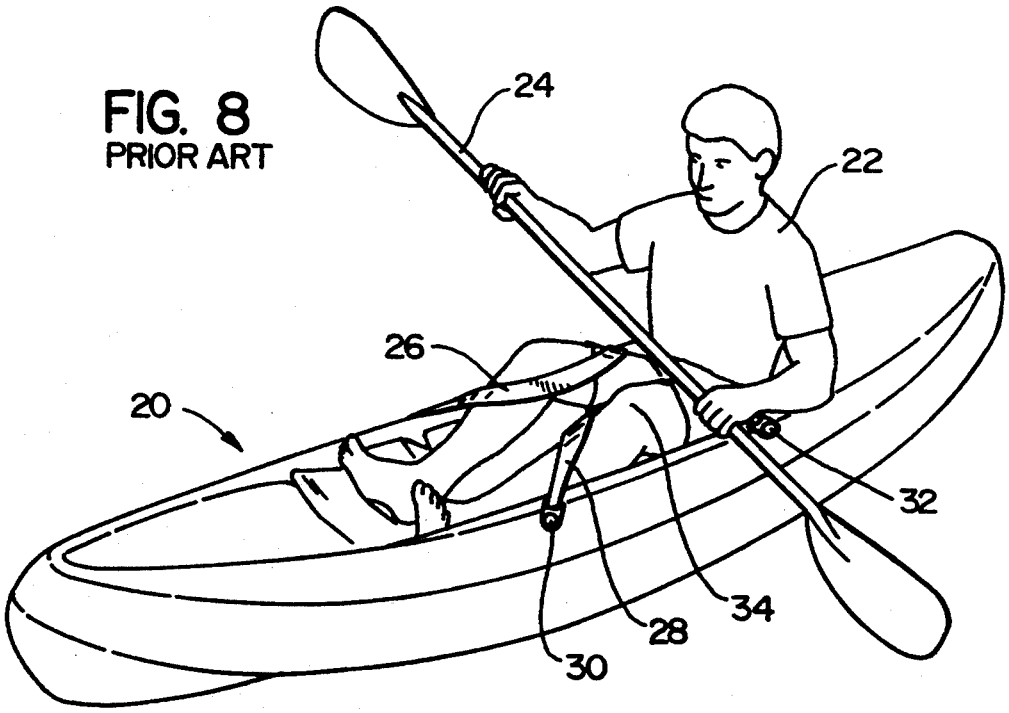
FIG. 8 PRIOR ART
FIG. 8 is a perspective view of a prior art sit-on-top kayak.

The kayak 120 is being operated by a kayaker 126 using a paddle 128. The kayaker 126 is sitting in an open cockpit area 130 on a seating surface 132 (FIGS. 2 and 6). A cockpit wall 134 extends a short distance above the seating surface 132 around the perimeter of the cockpit area 130. The brace member 124 is fixed relative to the hull 122 between the kayaker's legs 136 and 138 adjacent to the kayaker's knees **136*a* and 138*a* and/or thighs 136*b* and 138*b***.

To maintain control of the kayak 120 during use on rough water or in surf, the kayaker 126 grips the brace member 124, as shown in FIGS. 1 and 2, between the knees **136*a* and 138*a* and/or thighs 136*b* and 138*b*. However, should the kayaker 126 wish to exit the kayak 120, the kayaker 126 need only relax the gripping pressure on the brace member 124 and displace the legs 136 and 138 upwardly away from the seating surface 132. In other words, the kayaker 126 need only stand up out of the cockpit area 130 to exit the kayak 120 and need not contort the legs 136 and 138 outwardly to do so. It follows that, if the kayak 120 is upside down when the kayaker 126 wishes to exit the cockpit area 128, the kayaker 126 need only relax the pressure on the brace member 124** and fall out of the craft.

In any case, getting into and out of a kayak employing a brace member such as the member 124 described above is almost as easy as getting into and out of a kayak without such a brace member. However, the brace member 124 as described above can easily be gripped by the user when the kayaker desires additional control of the kayak.

Before discussing the present invention in further detail, the following terms should be defined. The terms "up" and "down" are in reference to a person sitting in the cockpit area 130 of the kayak 120 regardless of the orientation of the kayak with respect to the horizon. The terms "inner" and "outer" refer to those directions towards and away from the inside of the cockpit area 130, respectively. The terms "fore, front" and "aft, rear" refer to the directions towards the bow and stern, respectively, of the kayak 120. The kayak 120 has a longitudinal axis A extending through the center of the kayak 120 from the bow to the stern thereof (FIG. 1). The terms "lateral" or "sideways" refer to a direction orthogonal to the longitudinal axis A of the kayak 120.

Figure 7A:
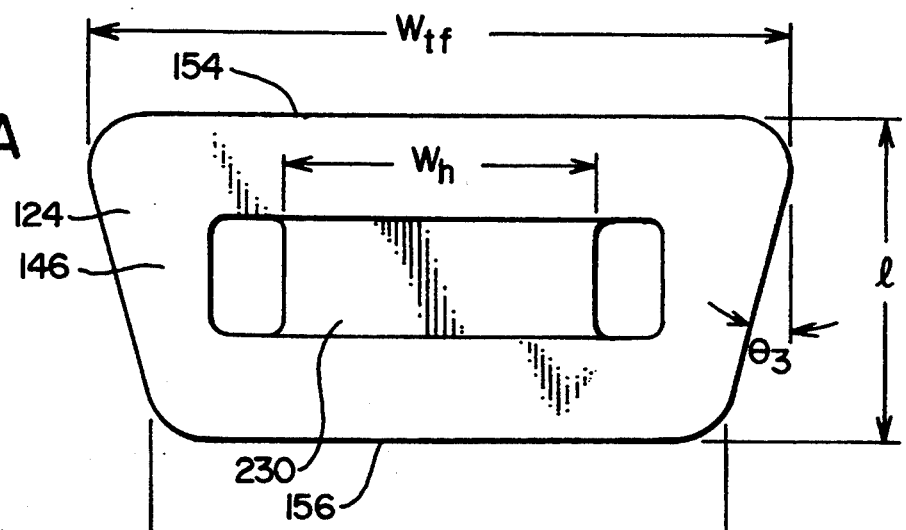
FIGS. 7A, 7B, and 7C are top, rear, and end views showing details of construction of the brace member depicted in FIG. 1.
Figure 7B:
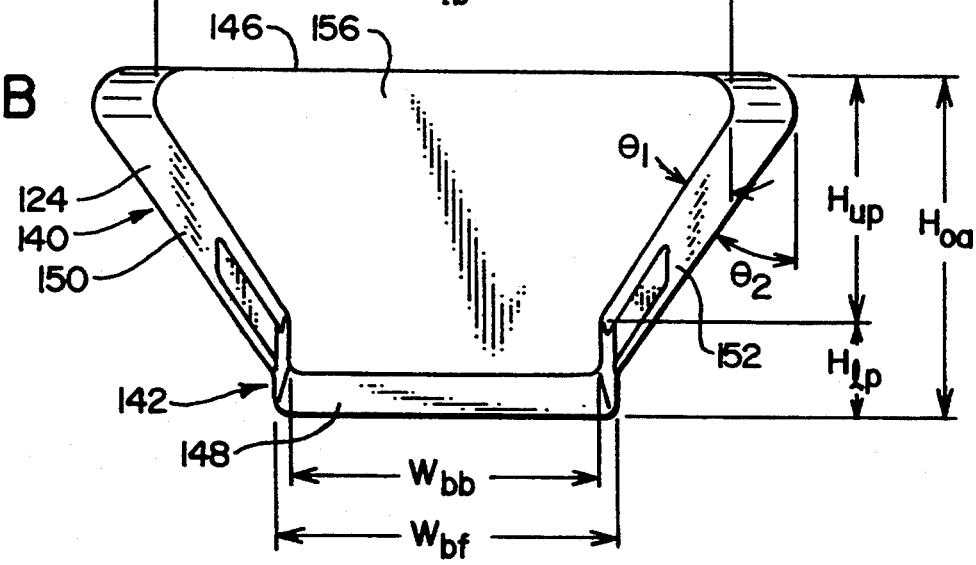
Figure 7C:
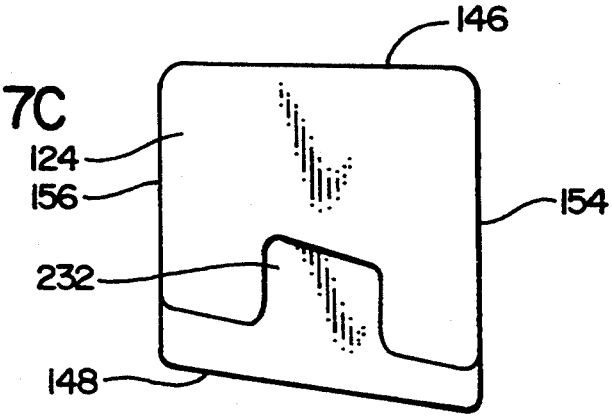

Referring now to FIGS. 7A, 7B, and 7C, the exemplary brace member 124 will be described in further detail. As shown in FIG. 7B, this brace member 124 has an upper portion generally indicated by reference character 140 and a lower portion generally indicated by reference character 142. The brace member 124 has six surfaces: a top surface 146; a bottom surface 148; a port side surface 150; a starboard side surface 152; a forward surface 154; and an aft surface 156.

The top surface 146, bottom surface 148, forward surface 154, and aft surface 156 are generally planar, while the remaining surfaces are non-planar. In particular, the port and starboard side surfaces 150 and 152 are nearly vertical at the brace member lower portion 140 and are outwardly canted at the brace member upper portion 138. The lateral cross-sectional perimeter (such as is shown in FIG. 2) of the brace member 124 is greater towards the forward surface 154 than the aft surface 156 such that the brace member 124 is flared outwardly in the forward direction.

With reference to FIGS. 7A, 7B, and 7C, the exact shape of the exemplary brace member 124 will be described in further detail. The outward canting of the brace member 124 described above is shown in FIG. 7B by angles $\theta_1$ and $\theta_2$. The angle $\theta_3$ shown in FIG. 7A shows the forward flaring of the brace member 124 described above. Certain dimensions of the brace member 124 have been found by the Applicant to be of importance. The overall height $H_{oa}$, height of the upper portion $H_{up}$, and height of the lower portion $H_{lp}$ and the bottom front width $W_{bf}$ and bottom back width Wbb are shown in FIG. 7B, while the top front width Wtf and top back width Wtb, hole width Wh, and lenght L are shown in FIG. 7A. The following table sets forth the critical angles and dimensions of the brace member 124, the preferred values for each of these angles and dimensions, and the ranges for these angles and dimensions within which the primary benefits of the present invention are obtained:

| ANGLE OR DIMENSION | PREFERRED VALUE | MIN. | MAX. |
|---|---|---|---|
| $W_{tf}$ | 10.5" | 8.0" | 12.0" |
| $W_{tb}$ | 9.0" | 7.0" | 11.0" |
| $W_{bf}$ | 5.0" | 4.0" | 7.0" |
| $W_{bb}$ | 4.5" | 3.0" | 6.0" |
| $W_h$ | 5.0" | 1.0" | 10.0" |
| L | 4.75" | 3.0" | 8.0" |
| $H_{oa}$ | 5.0" | 3.0" | 7.5" |
| $H_{up}$ | 4.5" | 3.0" | 5.0" |
| $H_{lp}$ | 0.5" | 0.0" | 2.5" |
| $\theta_1$ | 34° | 25° | 40° |
| $\theta_2$ | 35° | 25° | 40° |
| $\theta_3$ | 14° | 10° | 20° |

Another critical dimension as shown in FIG. 2 is the distance H that the brace member 124 is fixed above the seating surface 132. In the kayak 120, this distance is preferably 4.5" inches, and should be within 4.0" and 7.0" inches to obtain the benefits of the present invention.

Further, it is also important that the distance and spatial relationship between the cockpit walls 134 extending around the cockpit area 130 and the point on the brace member port and starboard sides 150 and 152 closest thereto be sufficient to allow the upward withdrawal of the legs 136 and 138 described above. In the exemplary kayak 120, the distance D between the brace member 124 and the cockpit walls 134 is approximately 5.75" inches and should, in any event, be no less than 5.0" inches for adults. It can also be seen that the highest point on the cockpit walls 134 is located approximately at the same vertical level as the bottom surface 148 of the brace member 124.

The port and starboard side surfaces 150 and 152 of the brace member 124 contact the kayaker's legs 136 and 138 when the brace member 124 is gripped therebetween. The compound angle provided to the port and starboard side surfaces 150 and 152 as described above causes these side surfaces 150 and 152 to conform to the legs 136 and 138, providing a large area of contact between the legs 136 and 138 and the brace member 124. This large contact area reduces wear and fatigue by distributing the loads transmitted between kayak 120 and kayaker 126 over a relatively large area.

It should be noted that it is very important to the operation of the brace member 124 that this brace member contact only the inner, and not the upper, portions of the kayaker's legs 136 and 138. If the port and starboard surfaces 150 and 152 become nearly horizontal and extend over the top of the legs 136 and 138, the legs cannot be withdrawn upwardly with ease; instead, the legs must simultaneously be moved outwardly around the brace member 124. This is a very awkward movement that may inhibit egress from the cockpit area 128.

The exact location of the brace member 124 relative to the kayaker 126 is not crucial and is a matter of individual taste and comfort. The brace member 124 can be located forward to be gripped between the kayaker's knees **136*a* and 138*a*, farther aft where it can be gripped by the kayaker's thighs 136*b* and 138*b*, or in an intermediate position where it is gripped by both the knees 136*a* and 138*a* and the thighs 136*b* and 138*b***.

Accordingly, the angles, dimensions, and spatial relationships described above allow the kayaker 126 to control the kayak 120, while also allowing the legs 136 and 138 to be easily withdrawn upwardly as described above to permit the kayaker 126 to exit the cockpit area 130.

Figure 3:
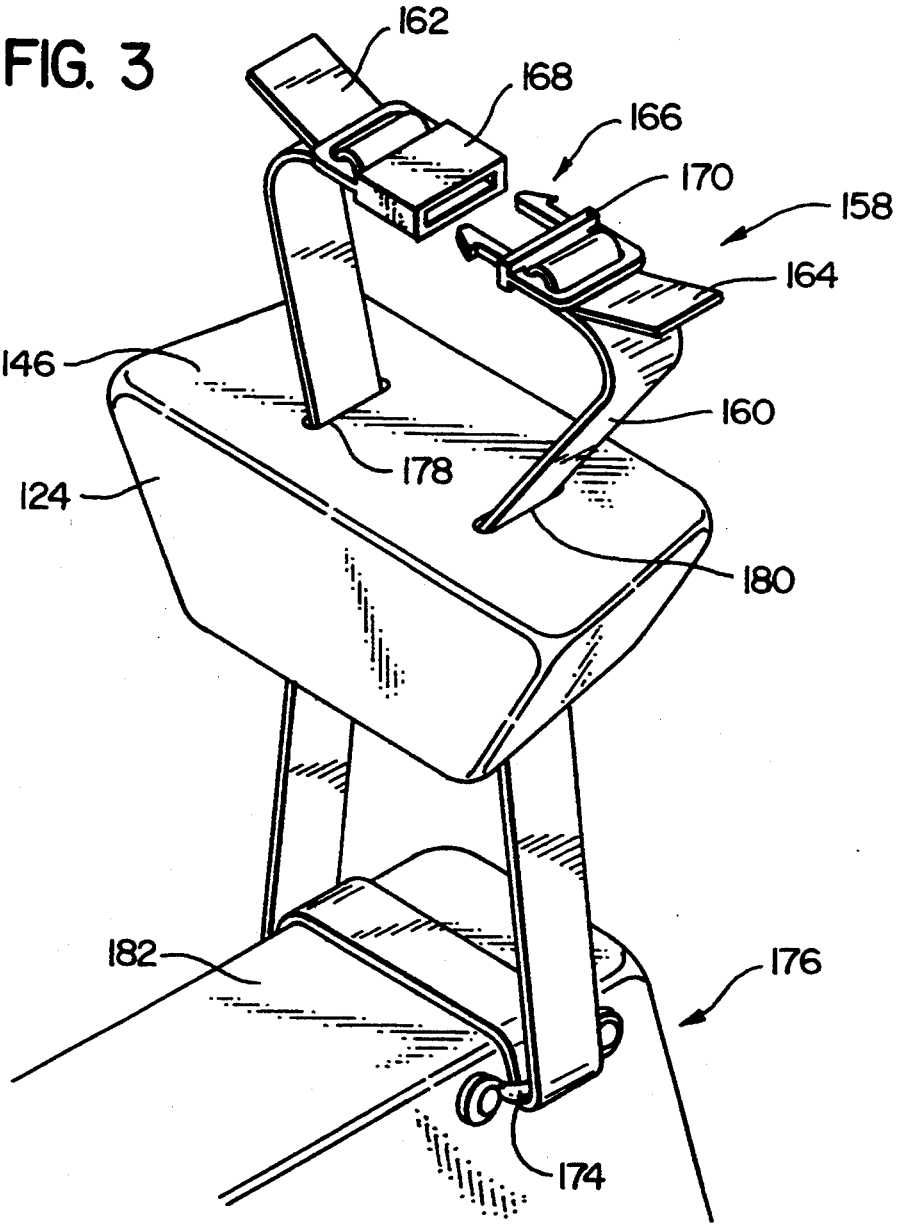
FIG. 3 is an exploded view showing the first means for fixing the brace member relative to the kayak hull depicted in FIG. 2.

Further details of assembly, operation, and use of the kayak 120 will now be described with reference to FIGS. 2–5. A first exemplary tiedown assembly 158 for mounting the brace member 124 onto the seating surface 132 is depicted in FIGS. 2 and 3. This tiedown assembly 158 comprises: (a) a strap 160 having first and second ends 162 and 164; (b) a connector 166 having a female portion 168 attached to the strap first end 162 and a male portion 170 attached to the strap second end 164; and (c) a pair of pad eyes 172 and 174 securely fastened to a support projection 176 integrally formed with and extending upwardly from the seating surface 130.

The strap 160 passes through first and second holes 178 and 180 in the brace member 124 such that the strap extends around at least a portion of the brace member 124. The strap also passes through the pad eyes 172 and 174. The female and male portions 168 and 170 of the connector 166 are joined together to form the strap 160 into a loop. The strap 160 is then tightened such that the bottom surface 148 of the brace member is drawn snugly against an upper surface 182 of the support projection 176. The connector 166 of the exemplary tiedown assembly 158 is located adjacent to the top surface 146 of the brace member 124. The brace member 124 may be used as described above to control the kayak 120 to which it is mounted.

Figure 4:
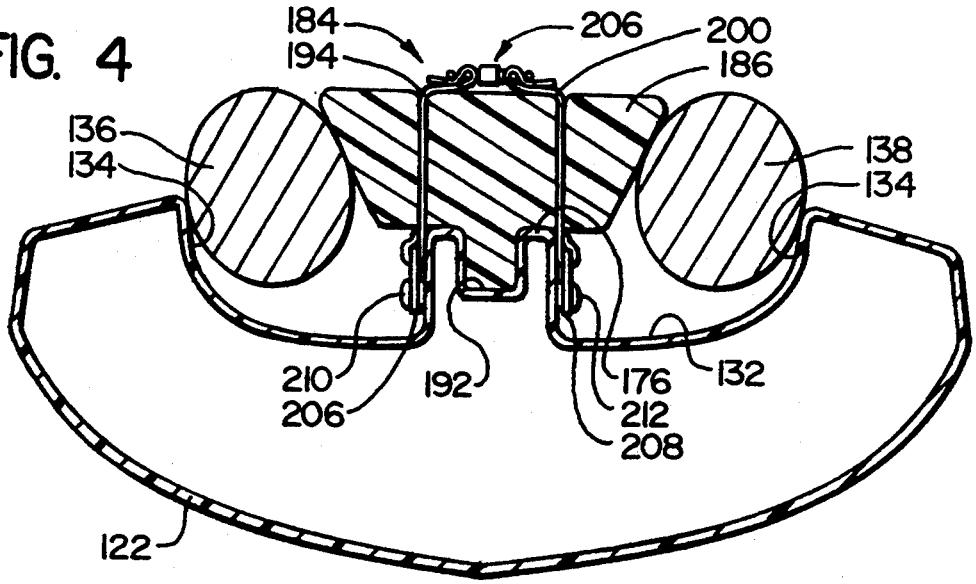
FIG. 4 is a cut-away view taken along lines 2—2 in FIG. 1 showing a second means for fixing the brace member relative to the kayak hull.
Figure 5:
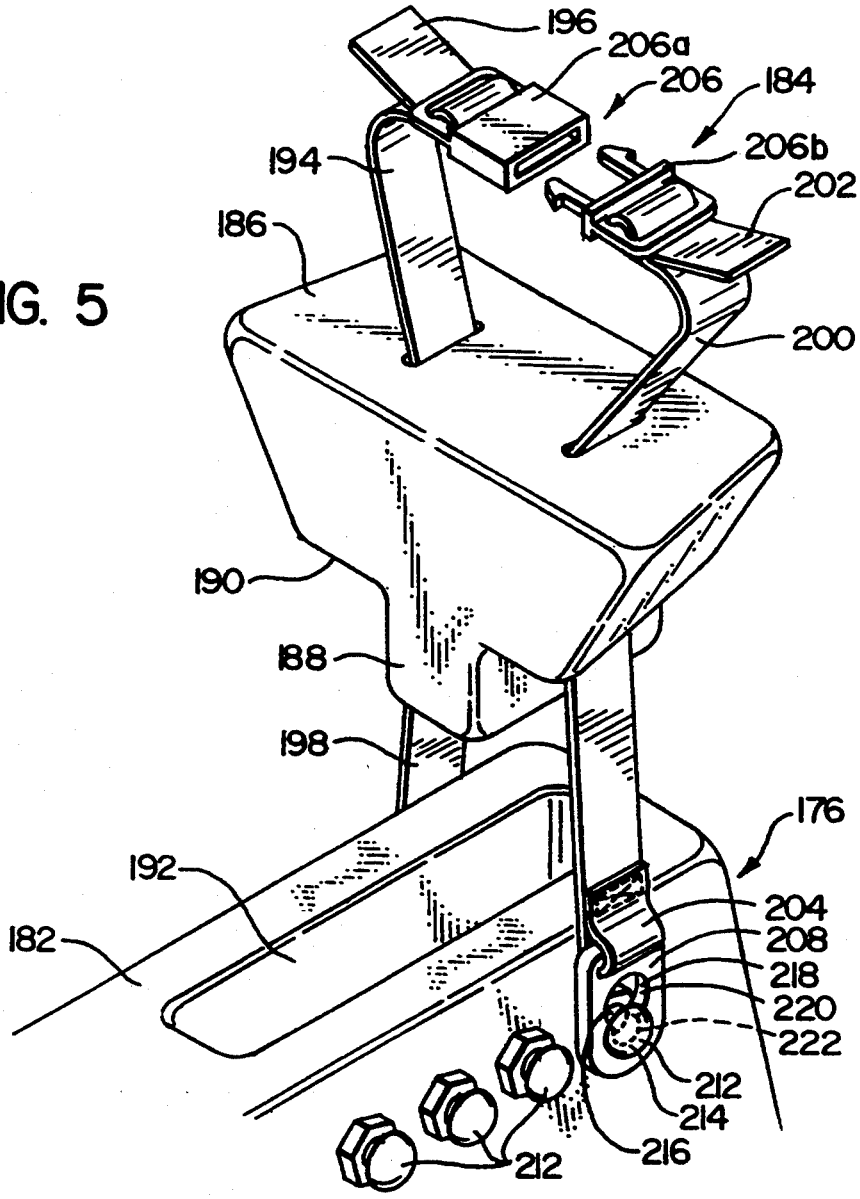
FIG. 5 is an exploded view showing the second means for fixing the brace member relative to the kayak hull depicted in FIG. 4.

A second exemplary tiedown assembly 184 for mounting a brace member onto the seating surface 132 is depicted in FIGS. 4 and 5. This tiedown assembly 184 allows the brace member to be moved forward and aft as is comfortable for the kayaker. In this case, the brace member has been slightly modified, and this modified brace member is identified by reference character 186. The brace member 186 is essentially the same as the brace member 124 described above except that a brace projection 188 extends downwardly from a bottom surface 190 of the brace member 186. Additionally, a slot 192 is formed in the upper surface 182 of the support projection 176.

The slot 192 is longer than the brace projection 188, but the width of the slot 192 and the width of the brace projection 188 are essentially the same, causing the projection 188 to be snugly received within the slot 192 in a manner that prevents lateral movement of the brace member 186 relative to the hull; however, the brace member 186 is able to slide fore and aft relative to the hull 122 and kayaker 126.

The tiedown assembly 184 fixes the brace member 186 in one of a plurality of positions within the slot 192. Referring to FIGS. 4 and 5, it can be seen that the tiedown assembly 184 comprises: (a) a first strap 194 having an upper end 196 and a lower end 198; (b) a second strap 200 having an upper end 202 and a lower end 204; (c) a fastener 206 having a female portion **206*a* attached to the upper end 196 of the first strap 194 and a male portion 206*b* attached to the upper end 202 of the second strap 200; (d) a perforated plate 206 (shown in FIG. 4 only) attached to the lower end 198 of the first strap 194; (e) a perforated plated 208 attached to the lower end 204 of the second strap 200; (f) a first set of projections 210 extending laterally to a first side of the support projection 176; and (g) a second set of projections 212 (only one shown in FIG. 4) extending laterally to a second side of the support projection 176**.

The projections 210 and 212 comprise a button or head portion 214 and a short, reduced diameter shank portion 216. Perforations 218 in the perforated plates 210 and 212 have an upper portion 220 through which the head portions 214 may pass and a lower portion 222 that can receive the shank portions 216 but through which the head portions 214 may not pass.

The tiedown assembly 184 operates as follows. With the brace projection 188 received within the slot 192, the brace member 186 is slid fore and aft until it is in a position that is comfortable for the kayaker 126. At that point, the plates 206 and 208 are placed over the projections 210 and 212 that correspond to the position at which the brace member 186 feels comfortable to the kayaker 126. To accomplish this, the plates 206 and 208 are brought towards the appropriate head portions 214 such that the head portions 214 pass through the upper portion 220 of the perforations 218. The plates 206 and 208 are then drawn up until the shank portions 216 are received within the perforation lower portion 222. The lower ends 198 and 204 of the straps 194 and 200 are thus attached to the hull 122 of the kayak 120. The fastener 206 is then used to join the upper ends 196 and 202 of the straps 194 and 200 together, at which time one or both of the straps 194 and 200 are pulled to bring the brace member 186 snugly against the upper surface 182 of the support projection 176.

The tiedown assembly 184 thus provides a simple and reliable method of allowing the brace member 186 to be adjusted fore and aft as is comfortable for a particular kayaker.

The exemplary brace members 124 and 186 described above are made of polyethylene using a rotational molding process. Accordingly, the brace members 124 and 186 are preferably molded at the same time as the hull 122, which is also made of polyethylene using a rotational molding process.

A kayak 120 incorporating either of the brace members 124 or 186 as described above is used in the following manner. The kayaker 126 sits in the cockpit area 130 on the seating surface 132 with the feet 224 and 226 in a footwell 228 (see FIG. 6). The kayaker 126 rests against the aft portion of the cockpit wall 124 with the legs 136 and 138 straddling the support member 176 and slightly bent such that the knees **136*a* and 138*a* extend slightly above the cockpit wall 134**.

When the kayaker 126 is paddling in a straight direction in calm waters, the legs 136 and 138 are relaxed. When it is necessary to turn the kayak 120 abruptly, such as in surf or whitewater conditions, the kayaker 126 grips the brace member 124 or 186 tightly between the legs 136 and 138. The kayaker 126 can then lean out of the kayak 120 to facilitate turning thereof without fear of falling out. However, should the craft flip over, in most cases the kayaker 126 need only release pressure on the brace member to fall out of the cockpit area 130 and swim to the surface.

Referring for a moment back to FIGS. 7A and 7C, it can be seen that recesses 230 and 232 can be formed in the brace member 124 to accommodate the strap 160.

From the foregoing, it should be clear that the present invention can be embodied in forms other than described above. The description set forth above is therefore to be considered in all respects illustrative and not restrictive, the scope of the invention being indicated by the appended claims rather than the foregoing description. All changes that come within the meaning and scope of the claims are intended to be embraced therein.

I claim:

1. A watercraft comprising:

a. a hull;

b. an open cockpit area in which an operator of the watercraft sits;

c. a brace member fixed relative to the hull within the cockpit area between operator's legs, where the operator maintains control of the watercraft by gripping the brace member between an inner side portion of each of the operator's legs; and d. mounting means for mounting the brace member to a seating surface on the hull within the cockpit area, where the mounting means comprises a strap formed in a loop, the strap being secured to the hull and extending around at least a portion of the brace member.

2. A watercraft as recited in claim 1, in which the mounting means further comprises at least one projection securely attached to the hull to which the strap is connected.

3. A watercraft as recited in claim 1, in which the strap passes through at least one hole in the brace member.

4. A watercraft as recited in claim 1, in which:

a. the strap passes through first and second holes in the brace member and first and second tiedown brackets mounted onto seating surface, the brace member being arranged with a bottom surface thereof adjacent to the first and second tiedown brackets; and b. a fastener is mounted on first and second ends of the strap to join the first and second ends together to form the loop, the fastener being arranged adjacent to an upper surface of the brace member.

5. A watercraft comprising;

a. a hull;

b. an open cockpit area in which an operator of the watercraft sits; and c. a brace member fixed relative to the hull within the cockpit area between the operator's legs, where the operator maintains control of the watercraft by gripping the brace member between an inner side portion of each of the operator's legs, where the brace member is adjustable fore and aft relative to the operator.

6. A watercraft comprising;

a. a hull;

b. an open cockpit area in which an operator of the watercraft sits; and c. a brace member fixed relative to the hull within the cockpit area between the operator's legs, where i. a brace projection extends from a bottom surface of the brace member; and ii. a brace slot adapted to receive the brace projection is formed in the hull to prevent lateral movement of the brave member relative to the hull.

7. A watercraft as recited in claim 6, further comprising a support projection extending upwardly from the seating surface, where the brace slot is formed in an upper surface of the support projection.

8. A watercraft as recited in claim 7, further comprising a strap having first and second ends, in which:

a. the strap passes through first and second holes in the brace member; and b. attachment means are formed on each of the first and second ends of the strap for allowing the ends of the strap to be attached to the support projection, thereby fixing the brace member relative to the hull.

9. A watercraft as recited in claim 8, in which the brace projection is moved forward in the brace slot to adjust the fore and aft position of the brace member relative to the operator.

10. A watercraft as recited in claim 9, in which the attachment means allow the ends of the strap to be attached to the support projection at a plurality of points along the projection.

11. A kayak comprising:

a. a hull;

b. an open cockpit area in which a kayaker sits on a seating surface of the hull;

c. a support projection integrally formed with and extending upwardly from the seating surface between the kayaker's legs; and d. a brace member fixed to the support projection, where the kayaker maintains control of the kayak by bringing the kayaker's legs together into contact with port and starboard sides of the brace member to grip the brace member, where the port and starboard sides of the brace member are outwardly canted.

12. A kayak as recited in claim 11, in which the the brace member comprises a lower portion and an upper upper portion, where the port and starboard sides of the brace member are substantially vertical in the lower portion and are outwardly and downwardly canted in the upper portion.

13. A kayak as recited in claim 11, in which the brace member is flared outwardly away from the kayaker.

14. A kayak comprising:

a. a hull;

b. an open cockpit area in which a kayaker sits on a seating surface of the hull;

c. a support projection integrally formed with and extending upwardly from the seating surface between the kayaker's legs; and d. a brace member fixed to the support projection, where the kayaker maintains control of the kayak by bringing the kayaker's legs together into contact with port and starboard sides of the brace member to grip the brace member, where the brace member is adjustable fore and aft relative to the operator.

* * * * *